US010530062B2

(12) United States Patent
Kahng

(10) Patent No.: US 10,530,062 B2
(45) Date of Patent: Jan. 7, 2020

(54) APPARATUS TO CREATE UNIFORM ELECTRIC-FIELD AND MAGNETIC-FIELD DISTRIBUTION AS METAMATERIAL ZEROTH-ORDER RESONANCE IN WAVEGUIDE AND CAVITY AND LEAKY-WAVE WAVEGUIDE ANTENNA FOR HIGH DIRECTIVITY RADIATION

(71) Applicant: INCHEON UNIVERSITY INDUSTRY ACADEMIC COOPERATION FOUNDATION, Incheon (KR)

(72) Inventor: Sung Tek Kahng, Seoul (KR)

(73) Assignee: INCHEON UNIVERSITY INDUSTRY ACADEMIC COOPERATION FOUNDATION, Incheon (KR)

( * ) Notice: Subject to any disclaimer, the term of this patent is extended or adjusted under 35 U.S.C. 154(b) by 293 days.

(21) Appl. No.: 15/347,074

(22) Filed: Nov. 9, 2016

(65) Prior Publication Data

US 2017/0194708 A1 Jul. 6, 2017

(30) Foreign Application Priority Data

Dec. 31, 2015 (KR) ..... 10-2015-0191260

(51) Int. Cl.
*H01Q 13/22* (2006.01)
*H01P 7/06* (2006.01)
(Continued)

(52) U.S. Cl.
CPC ..... *H01Q 13/22* (2013.01); *H01P 3/12* (2013.01); *H01P 3/123* (2013.01); *H01P 7/06* (2013.01);
(Continued)

(58) Field of Classification Search
CPC ..... H01P 3/123; H01P 3/12; H01Q 13/22
(Continued)

(56) References Cited

U.S. PATENT DOCUMENTS 3,763,447 A * 10/1973 Takahashi et al. ..... H01P 1/202 333/202
3,939,443 A * 2/1976 Biro et al. ..... H01P 1/205 333/202
4,334,229 A * 6/1982 Boblett ..... H01Q 13/22 343/767

FOREIGN PATENT DOCUMENTS

KR 10-1238258 B1 2/2013

OTHER PUBLICATIONS

Korean Patent Abstract (in English) of KR Pat. No. 101238258 B1, Date Feb. 27, 2013, downloaded Oct. 19, 2016 from http://engpat.kipris.or.kr/engpat/.

(Continued)

*Primary Examiner* — Benny T Lee
(74) *Attorney, Agent, or Firm* — Barceló, Harrison & Walker, LLP

(57) ABSTRACT

An apparatus to create uniform electric and magnetic-field distribution as zeroth-order resonance in a waveguide and a cavity according to an embodiment of the present invention includes a rectangular waveguide with a rectangular-shaped cross section comprising a cavity in the inside, and a conductive helical wire inserted into the cavity of the waveguide, wherein the main body of the conductive helical wire does not contact the inner surfaces of the waveguide at a predetermined gap, and both ends of the conductive helical wire are short-circuited to the inner surface of the waveguide, so as to create a uniform electric field and magnetic field throughout the entire waveguide.

10 Claims, 8 Drawing Sheets

(51) Int. Cl.

| | |
|---|---|
| ***H01Q 13/12*** | (2006.01) |
| ***H01P 3/12*** | (2006.01) |
| ***H01P 3/123*** | (2006.01) |
| ***H01Q 5/55*** | (2015.01) |
| ***H01Q 1/36*** | (2006.01) |
| ***H01Q 13/20*** | (2006.01) |

(52) U.S. Cl.
CPC ..... *H01Q 1/36* (2013.01); *H01Q 5/55* (2015.01); *H01Q 13/12* (2013.01); *H01Q 13/203* (2013.01)

(58) Field of Classification Search
USPC ..... 333/239, 237; 343/771
See application file for complete search history.

(56) References Cited

OTHER PUBLICATIONS

Kim, D-J. et al.; "CRLH Rectangular Waveguide with Balanced Conditions above Cut-off Frequency"; JEES; vol. 22, Issue 9; 2011; pp. 921-918.
Abstract (in English) of Kim, D-J. et al.; "CRLH Rectangular Waveguide with Balanced Conditions above Cut-off Frequency"; JEES; vol. 22, Issue 9; 2011; pp. 921-918.

* cited by examiner

APPARATUS TO CREATE UNIFORM ELECTRIC-FIELD AND MAGNETIC-FIELD DISTRIBUTION AS METAMATERIAL ZEROTH-ORDER RESONANCE IN WAVEGUIDE AND CAVITY AND LEAKY-WAVE WAVEGUIDE ANTENNA FOR HIGH DIRECTIVITY RADIATION

CROSS-REFERENCE TO RELATED APPLICATIONS

This application claims priority from Korean Patent Application No. 10-2015-0191260, filed Dec. 31, 2015, in the Korean Intellectual Property Office. The entire contents of said application is incorporated herein by reference for all purposes.

BACKGROUND

Technical Field

The present invention relates to an apparatus to create the uniform electric-field and magnetic-field distribution as zeroth-order resonance in a waveguide and a cavity and a leaky-wave waveguide antenna for high directivity radiation from 1 slot as a small structure.

Background Art

The rectangular waveguide is a transmission line guiding high frequency signals. In particular, it has excellent properties as a microwave transmission line with low loss, high quality-factor and high-power handling.

Meanwhile, a general waveguide has a distribution where the phase and size of the electric field and magnetic field of the basic and higher-order modes of transverse electric (TE) and transverse magnetic (TM) vary periodically like the standing wave in the waveguide and cavity. The electric field has an energy distribution alternating up and down with respect to the transmission direction, and the magnetic field has an energy distribution alternating to the left and right with respect to the transmission direction.

Therefore, in case of forming a microwave resonator by opening or shortening both the ends of the waveguide, there is a problem that the energy of the electric field and magnetic field change up and down or left to right, thereby failing to convey the equal power-density over the entire internal space of the cavity, which causes a microwave oven or RF heater not to have the desirable heat distribution.

Also, as for the existing slot-array travelling-wave or leaky-wave antenna used for radar detectors, etc., since a plurality of slits separated by half-wavelength intervals need to be formed in order to generate a beam for good directivity, and thus there is a problem that the size of the antenna gets bigger and therefore experiences more insertion loss.

Prior Art Reference

Patent Document (Patent document 1) KR10-1238258 B1

Non-Patent Document (Non-patent document 1) CRLH rectangular waveguide with balanced condition above cut-off frequency (Journal of KIEES, Volume 22, Issue 9, September 2011)

SUMMARY OF THE INVENTION

It is an objective of the present invention to provide an apparatus to create the uniform electric-field and magnetic-field distribution as zeroth-order resonance in a waveguide and a cavity, capable of conveying the equal power density over the entire volume of the waveguide applicable to microwave ovens, TEM-cells, RF heaters.

It is another objective of the present invention to provide a leaky-wave waveguide antenna for high directivity radiation, capable of obtaining a radiation pattern of high directivity while being 0.5 times smaller than the size of the existing leaky-wave antenna, due to eliminating the typical restriction of half-wavelength distances of the slot array.

In order to achieve the above objectives, the apparatus to create the uniform electric and magnetic-field distribution as zeroth-order resonance in a waveguide and a cavity according to an embodiment of the present invention includes a rectangular waveguide, and a conductive helical wire inserted into the cavity of the waveguide, wherein the main body of the conductive helical wire does not contact the inner surfaces of the waveguide at a predetermined gap, and both ends of the conductive helical wire are short-circuited to the inner surface of the waveguide, wherein the number of the turns and spacing between the pitches of the conductive helical wire are predetermined.

With regard to the apparatus to create uniform electric and magnetic-field distribution as zeroth-order resonance in the waveguide and cavity according to an embodiment of the present invention, the target zeroth-order resonance frequency of the waveguide will change the evanescent mode below the cut-off frequency of the waveguide to metamaterial left-handed region propagation mode or resonance mode.

Also, with regard to the apparatus to create uniform electric and magnetic-field distribution as zeroth-order resonance in the waveguide and cavity according to an embodiment of the present invention, the conductive helical wire may be arranged in the longitudinal direction of the waveguide and arranged as a coil along the inner surfaces of the waveguide.

Also, with regard to the apparatus to create uniform electric and magnetic-field distribution as zeroth-order resonance in the waveguide and cavity according to an embodiment of the present invention, the conductive helical wire may include a metal helical wire.

Also, with regard to the apparatus to create uniform electric and magnetic-field distribution as zeroth-order resonance in the waveguide and cavity according to an embodiment of the present invention, the conductive helical wire may have a repeated structure with an uncoiled length of at least two wavelengths as a whole, at a half-wavelength distance of the target zeroth-order resonance frequency in the longitudinal direction of the waveguide. The total coiled length of the helical wire can be much less than two wavelengths.

In order to achieve a small waveguide antenna, the leaky-wave waveguide antenna for high-directivity radiation according to an embodiment of the present invention includes a rectangular waveguide with a rectangular-shaped cross section including an internal cavity, and a conductive helical wire inserted into the cavity of the waveguide, wherein the main body of the conductive helical wire does not contact the inner surfaces of the waveguide at a predetermined gap, and both ends of the conductive helical wire are short-circuited to the inner surface of the waveguide, wherein the waveguide comprises a single predetermined-length slit formed in the longitudinal direction penetrating the upper surface.

With regard to the leaky-wave waveguide antenna for high directivity radiation according to an embodiment of the present invention, the target zeroth-order resonance frequency of the waveguide will change the evanescent mode below the cut-off frequency of the waveguide to metamaterial left-handed region propagation mode or resonance mode.

Also, with regard to the leaky-wave waveguide antenna for high directivity radiation according to an embodiment of the present invention, the conductive helical wire may be arranged in the longitudinal direction of the waveguide and arranged to coil along the inner surfaces of the waveguide.

Also, with regard to the leaky-wave waveguide antenna for high directivity radiation according to an embodiment of the present invention, the conductive helical wire may include a metal helical wire.

Also, with regard to the leaky-wave waveguide antenna for high directivity radiation according to an embodiment of the present invention, the conductive helical may have a repeated structure with a length of at least two wavelengths as a whole, comprising two coils at a half-wavelength distance of the target zeroth-order resonance frequency in the longitudinal direction of the waveguide.

According to the apparatus to create uniform electric and magnetic-field distribution as zeroth-order resonance in the waveguide and cavity according to an embodiment of the present invention, uniform electric field and magnetic field may be generated throughout the entire waveguide. Also, according to the leaky-wave waveguide antenna for high directivity radiation according to an embodiment of the present invention, a pattern of high directivity radiation may be obtained while being 0.5 times smaller than the size of the existing leaky-wave antenna.

DETAILED DESCRIPTION OF THE PREFERRED EMBODIMENTS

Figure 1:
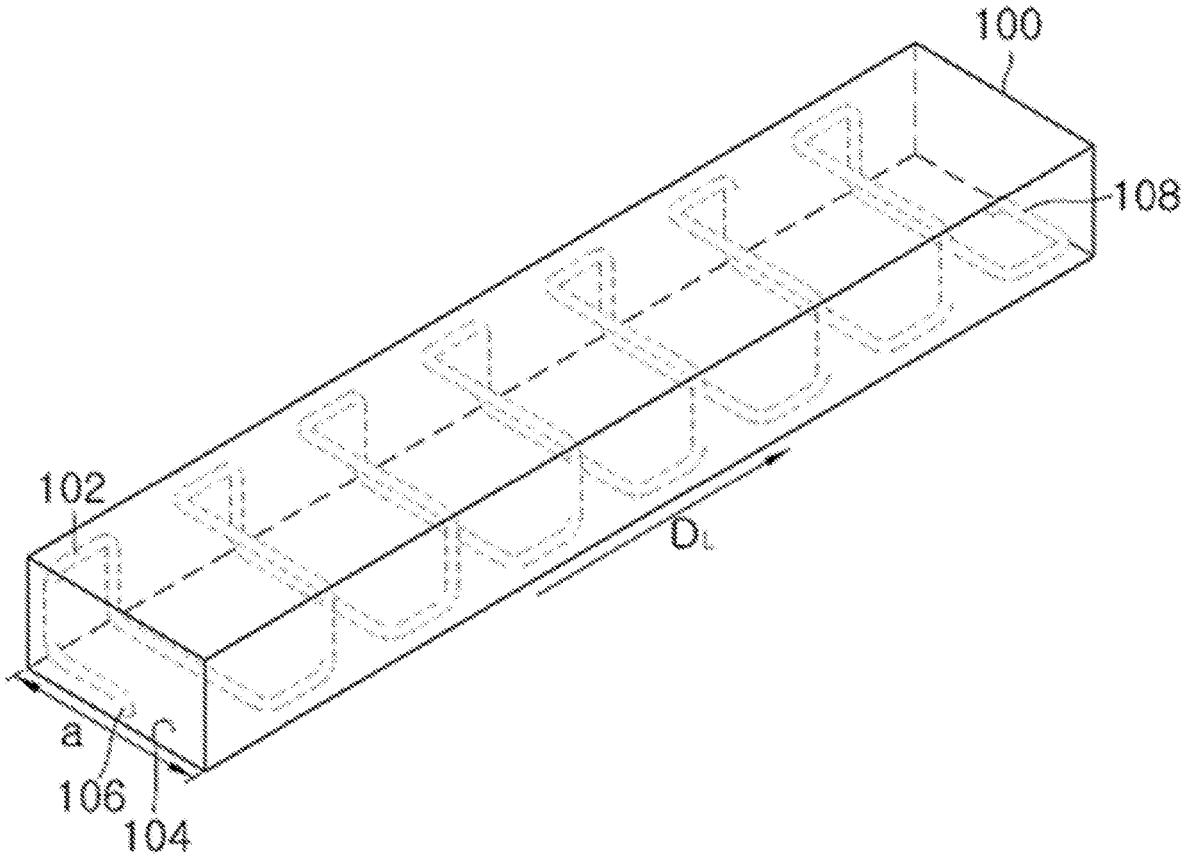
FIG. 1 is a view illustrating a structure of the apparatus to create uniform electric-field and magnetic-field distribution as zeroth-order resonance in the waveguide and cavity according to an embodiment of the present invention.

The above and other objects, features and other advantages of the present invention will be more clearly understood from the following detailed description and preferred embodiments when taken in conjunction with the accompanying drawings.

First of all, terms or words used in the specification and the claims should not be interpreted as a general and dictionary meaning and should be interpreted as a meaning and a concept which conform to the technical spirit of the present invention based on a principle that an inventor can appropriately define a concept of a term in order to describe his/her own disclosure by the best method.

As for reference numerals associated with parts in the drawings, the same reference numerals will refer to the same or like parts throughout the drawings.

Also, it will be understood that, although the terms "first," "second," "one side," "the other side," etc. may be used herein to describe various elements, these elements should not be limited by these terms. These terms are only used to distinguish one element from another.

In the following description, detailed explanation on known related technologies may be omitted to avoid unnecessarily obscuring the subject matter of the present invention.

Hereinafter, preferred embodiments of the present invention will be described in detail with reference to the accompanying drawings.

FIG. 1 is a view illustrating a structure of the apparatus to create uniform electric-field and magnetic-field distribution as zeroth-order resonance in the waveguide and cavity according to an embodiment of the present invention.

Referring to FIG. 1, the apparatus to create uniform electric-field and magnetic-field distribution as zeroth-order resonance in the waveguide and cavity according to an embodiment of the present invention includes a rectangular waveguide 100 with a rectangular-shaped cross section having a width "a" and including an internal cavity, and a conductive helical wire 102 arranged in the cavity of the waveguide 100, formed of a conductive material metal, wherein the conductive helical wire 102 is arranged to be separated from the inner surfaces of the waveguide 100 at a predetermined gap while being adjacent to the inner surfaces of the waveguide 100, and both ends 106, 108 of the conductive helical wire 102 are short-circuited to the bottom surface 104 of the waveguide 100.

The target zeroth-order resonance frequency of the waveguide 100 is obtained by changing an evanescent mode of the metallic waveguide or cavity which is initially equal to or less than the cut-off frequency (fc) of the waveguide 100 into a propagation mode as the double negative or left-handed region.

The conductive helical wire 102 may be arranged in the longitudinal direction (DL) of the waveguide 100 and arranged to coil along the inner surfaces of the waveguide 100.

The conductive helical wire 102 has a repeated structure with an uncoiled length of at least two wavelengths as a whole, comprising two coils at a half-wavelength distance of the target zeroth-order resonance frequency in the longitudinal direction (DL) of the waveguide 100. The total coiled length of the helical wire can be much less than two wavelengths.

The waveguide 100 does not transmit waves unless the operating frequency is equal to or greater than the cut-off frequency (fc), and thus there is no wave propagating. Also, the metal waveguide and cavity present a negative effective permittivity property unique to the waveguide in an evanescent mode.

The apparatus to create uniform electric-field and magnetic-field distribution as zeroth-order resonance in the waveguide and cavity according to an embodiment of the present invention sets the target resonance frequency in the evanescent mode region, which is a region below the cut-off frequency (fc) of the waveguide 100 so that the waveguide 100 presents a unique negative effective permittivity property.

By adjusting the length, pitch-spacing, turns and thickness of the conductive helical wire 102, and length between the parts formed of capacitance therebetween in the conductive helical wire 102, the resonance frequency may be set in the evanescent mode region, which is a region below the cut-off frequency of the waveguide 100.

Figure 2:
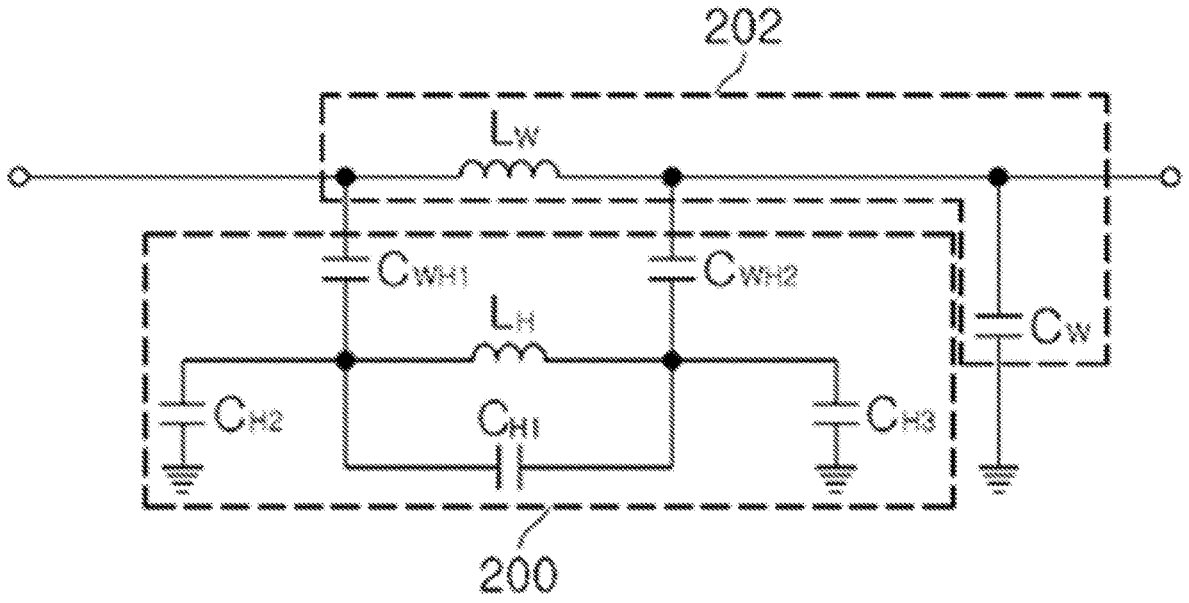
FIG. 2 is a view illustrating an equivalent circuit of the apparatus to create uniform electric-field and magnetic-field distribution as zeroth-order resonance in the waveguide and cavity according to an embodiment of the present invention.

FIG. 2 is a view illustrating an equivalent circuit of the apparatus to create uniform electric-field and magnetic-field distribution as zeroth-order resonance in the waveguide and cavity according to an embodiment of the present invention illustrated in FIG. 1.

In FIG. 2, reference numeral 200 refers to the capacitors (CH1, CH2, CH3, CWH1, CWH2) and inductor (LH) created by arranging the helical wire 102 in the cavity inside the waveguide 100, and reference numeral 202 refers to the inductor (LW) and capacitor (CW) by the equivalent circuit expression of the waveguide 100.

The apparatus to create uniform electric-field and magnetic-field distribution as zeroth-order resonance in the waveguide and cavity according to an embodiment of the present invention illustrated in FIG. 1 presents right-handed properties by the inductor (LW) and capacitor (CW) within the block represented by reference numeral 202, and presents left-handed properties by the capacitors (CH1, CH2, CH3, CWH1, CWH2) and inductor (LH) within the block represented by reference numeral 200.

Thus, due to the conductive helical wire 102 arranged inside the waveguide 100, the apparatus to create uniform electric-field and magnetic-field distribution as zeroth-order resonance in the waveguide and cavity according to an embodiment of the present invention has negative effective permittivity below the cut-off frequency (fc) of the waveguide 100.

As mentioned above, as the apparatus to create uniform electric-field and magnetic-field distribution as zeroth-order resonance in the waveguide and cavity according to an embodiment of the present invention has a negative effective permittivity below the cut-off frequency (fc) due to the unique properties of the waveguide 100 and has a negative effective permittivity due to the conductive helical wire 102 arranged in the cavity of the waveguide 100, zeroth-order resonance of composite right/left-handed (CRLH) structure occurs in the target resonance frequency below the cut-off frequency (fc) of the waveguide 100.

Figure 3:
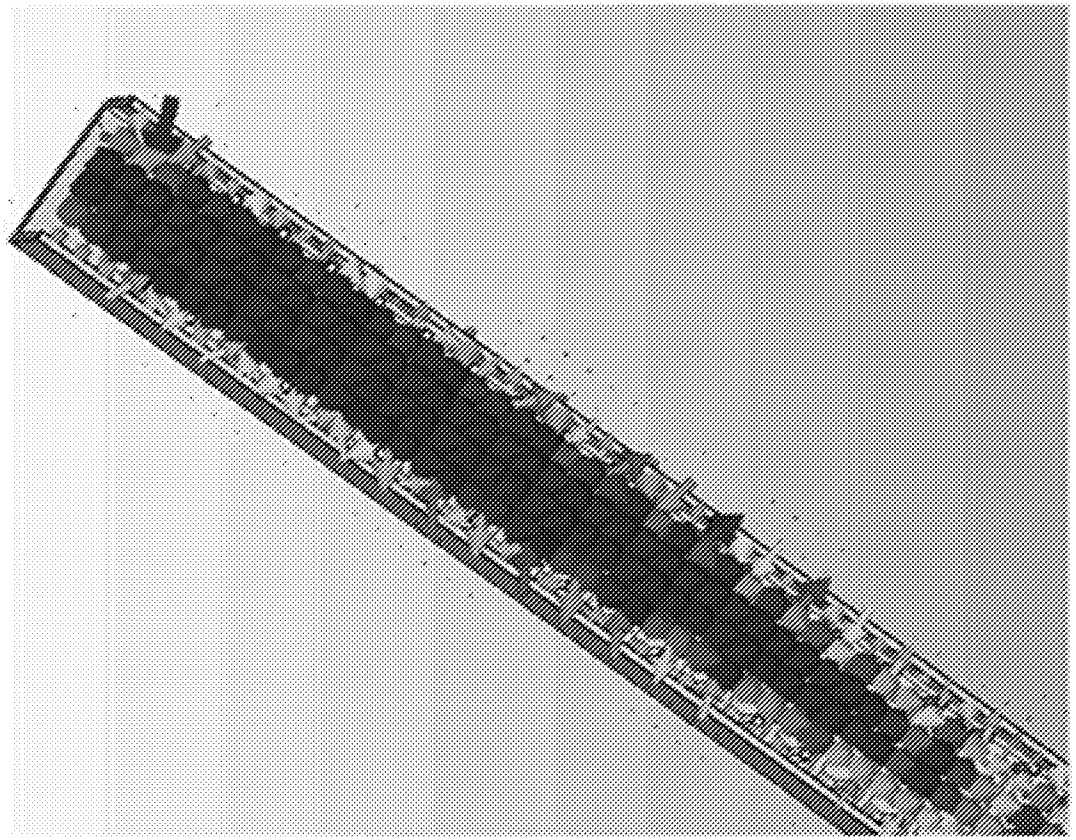
FIG. 3 is a view illustrating an electric-field distribution generated in the apparatus to create uniform electric-field and magnetic-field distribution as zeroth-order resonance in the waveguide and cavity according to an embodiment of the present invention.
Figure 4:
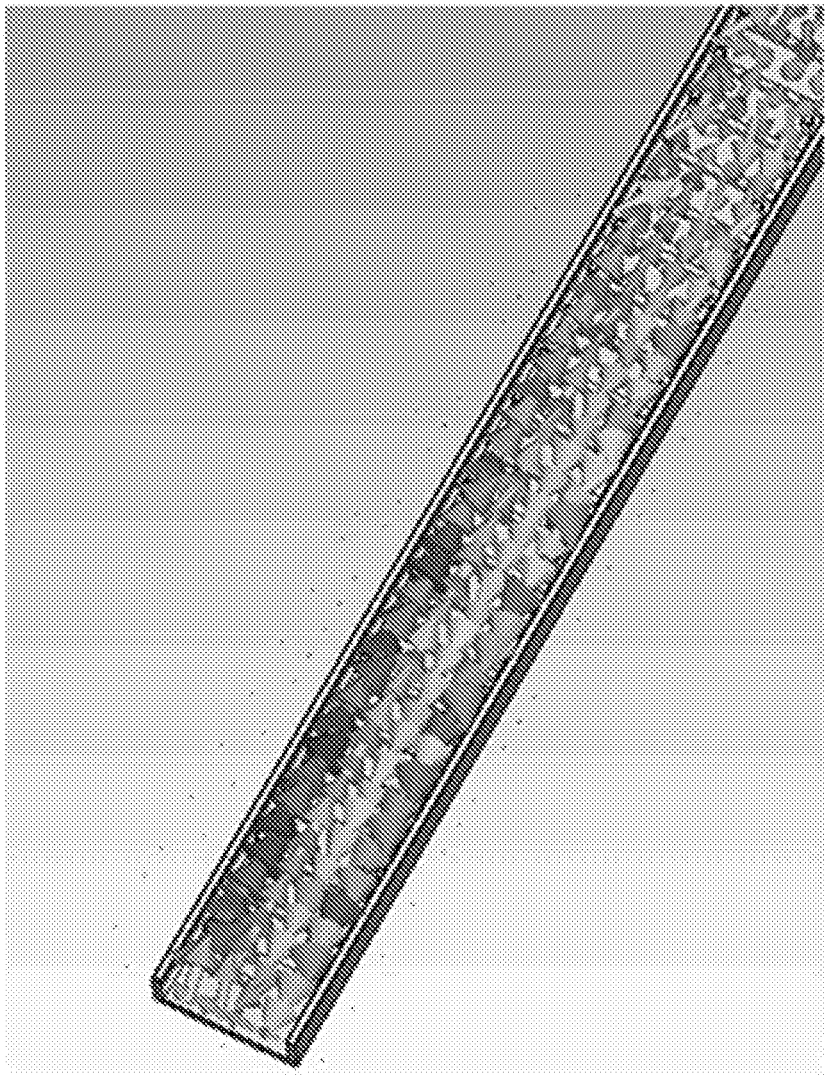
FIG. 4 is a view illustrating a magnetic-field distribution generated in the apparatus to create uniform electric-field and magnetic-field distribution as zeroth-order resonance in the waveguide and cavity according to an embodiment of the present invention.

As zeroth-order resonance of CRLH structure occurs in the apparatus to create uniform electric-field and magnetic-field distribution as zeroth-order resonance in the waveguide and cavity according to an embodiment of the present invention, inside the waveguide 100, a magnetic field is created in one direction as illustrated in FIG. 4, and an electric field is created in one direction as illustrated in FIG. 3, so that a uniform electromagnetic distribution is created by creating a uniform electric field and a uniform magnetic field. As skilled artisans will readily recognize, FIG. 3 shows electric field vectors of the zeroth-order resonance and FIG. 4 shows magnetic field vectors of the zeroth-order resonance, where in FIGS. 3 and 4, darker areas indicate stronger fields.

Thus, according to the apparatus to create uniform electric-field and magnetic-field distribution as zeroth-order resonance in the waveguide and cavity according to an embodiment of the present invention, zeroth-order resonance of CRLH structure is created to provide a uniform electric field and magnetic field throughout the entire waveguide 100. Accordingly, it may be applied to a microwave oven evenly cooking food or to an apparatus for electromagnetic perturbation or electromagnetic interference ("EMI") measurement.

Figure 5:
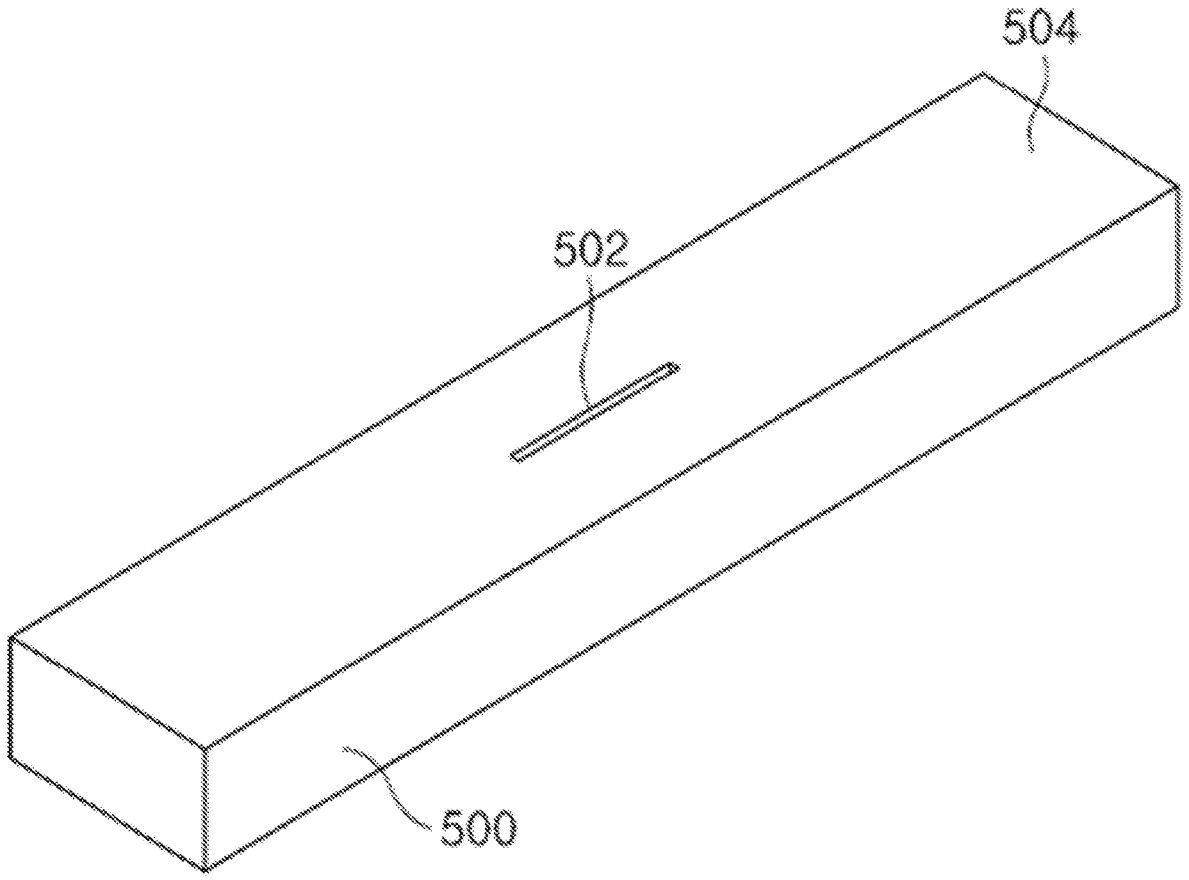
FIG. 5 is a view illustrating a structure of the leaky-wave waveguide antenna for high directivity radiation according to an embodiment of the present invention.

Meanwhile, FIG. 5 is a view illustrating a structure of the leaky-wave waveguide antenna for high directivity radiation according to an embodiment of the present invention.

In the leaky-wave waveguide antenna for high directivity radiation according to an embodiment of the present invention illustrated in FIG. 5, the waveguide 500 is formed in a structure similar to the waveguide 100 illustrated in FIG. 1.

Although not illustrated in the drawings (e.g., FIG. 5), a conductive helical wire 102 as illustrated in FIG. 1 is arranged in the same manner inside the waveguide 500.

The waveguide 500 illustrated in FIG. 5 includes one short slit 502 formed in the longitudinal direction penetrating the upper surface 504.

Figure 8:
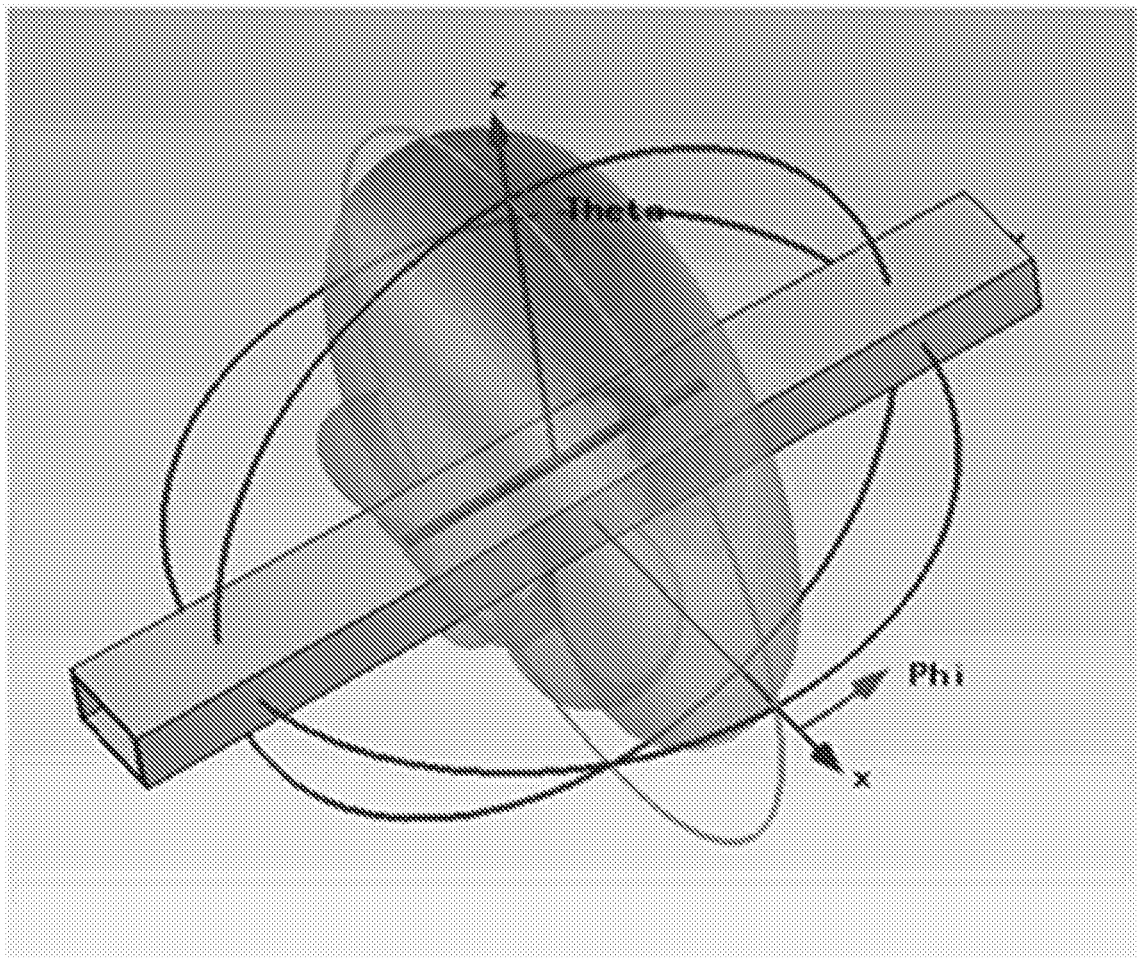
FIG. 8 is a view illustrating a beam for high directivity radiation generated in the leaky-wave waveguide antenna for high directivity radiation according to another embodiment of the present invention illustrated in FIG. 7.

As skilled artisans will readily recognize, to show the far-field radiated pattern (or beam pattern) of an antenna, an antenna designer typically uses spherical coordinates to plot the beam pattern. The spherical coordinates include theta (i.e., elevation angle measured from the z-axis), phi (i.e., azimuth angle measured on the xy plane), and r (i.e., the distance from the coordinates' center to the point on the beam pattern). The axes (x, y, and z in the rectangular coordinates and theta, phi, and r in the spherical coordinates) are helpful to show the directions of the beam and the relationships with the geometry as shown in FIGS. 6 and 8.

Figure 6:
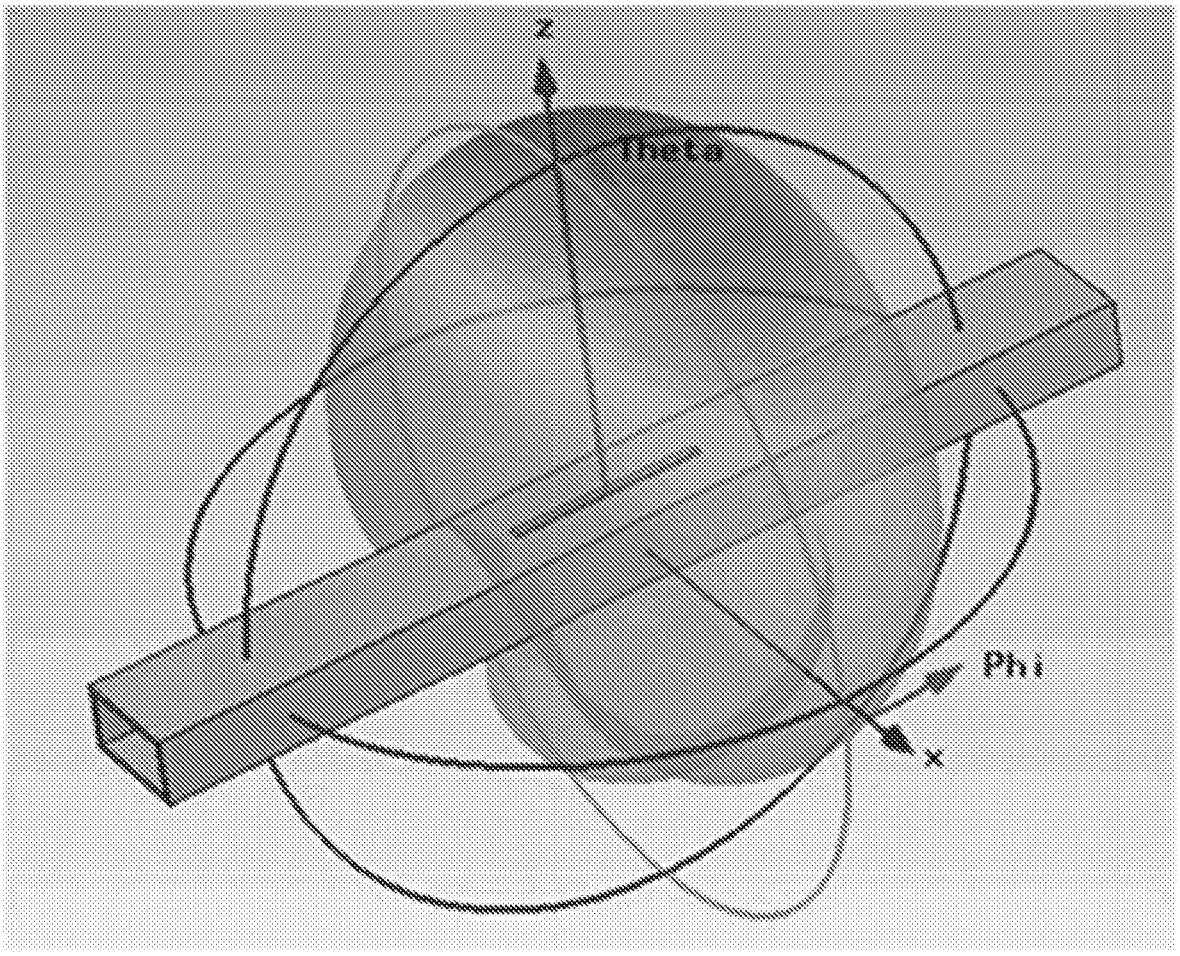
FIG. 6 is a view illustrating a beam for directivity radiation generated in the leaky-wave waveguide antenna for high directivity radiation according to an embodiment of the present invention illustrated in FIG. 5.

As illustrated in FIG. 6, the slit 502 (FIG. 5) plays the role of radiating the energy formed by generating zeroth-order resonance in the waveguide 500 (FIG. 5) to the outside as a good directivity radiation beam.

Figure 7:
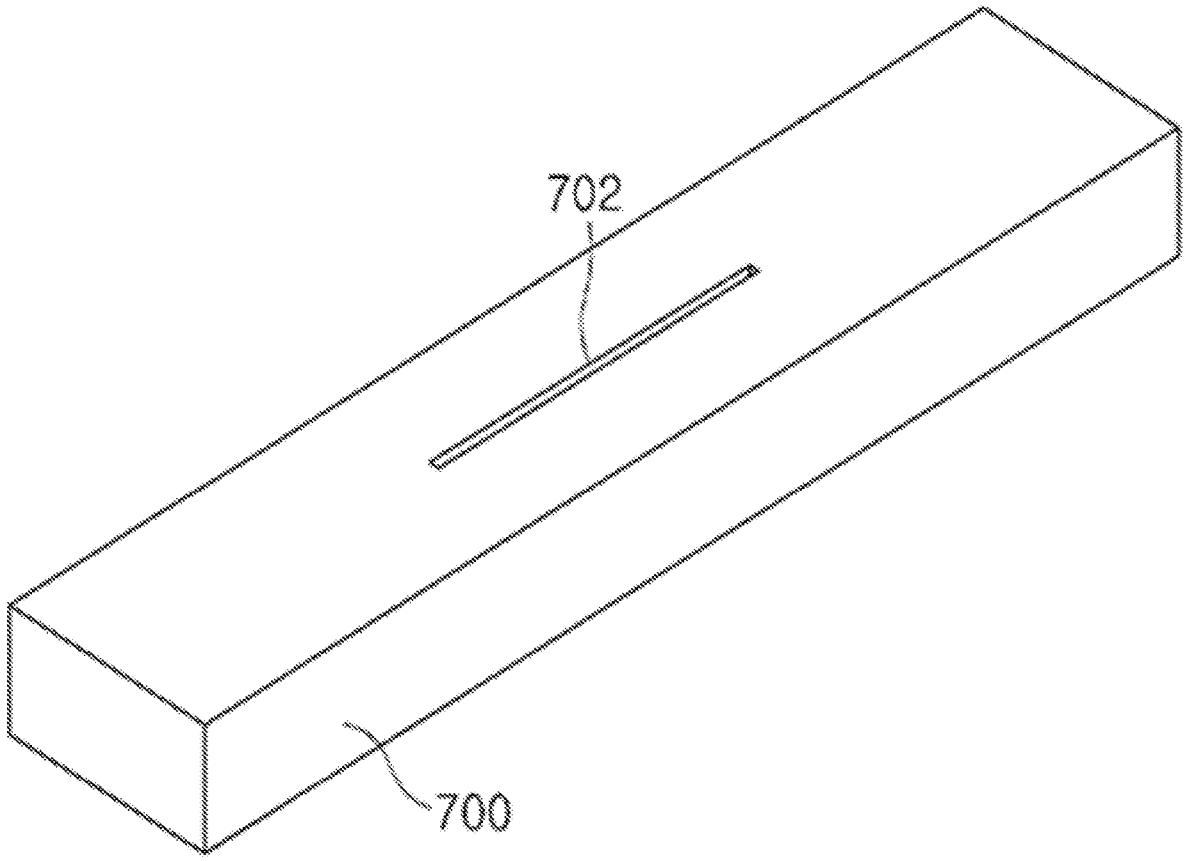
FIG. 7 is a view illustrating a structure of the leaky-wave waveguide antenna for high directivity radiation according to another embodiment of the present invention.

FIG. 7 is a view illustrating a structure of the leaky-wave waveguide antenna for high directivity radiation according to another embodiment of the present invention.

The structure of the leaky-wave waveguide antenna for high directivity radiation according to another embodiment of the present invention illustrated in FIG. 7 has the same structure as the leak-wave waveguide antenna for high directivity radiation illustrated in FIG. 5 except that the length of the slot 702 is slightly longer than the slot 502 illustrated in FIG. 5.

As illustrated in FIG. 8, the leaky-wave waveguide antenna for high directivity radiation illustrated in FIG. 7 radiates the energy formed by generating zeroth-order resonance in the waveguide 700 (FIG. 7) to the outside as a directivity radiation beam.

The existing leaky-wave antenna obtains a directivity radiation beam only by having a plurality of slits separated by half-wavelength intervals, which results in ordinary slot-array as very long structures. However, the leaky-wave waveguide antenna for high directivity radiation according to an embodiment of the present invention illustrated in FIG.

5 and FIG. 7 can obtain directivity radiation similar to the existing leaky-wave antenna even by forming one short slit in the waveguide. Thus, a high directivity radiation pattern may be created while reducing the size of the leaky-wave waveguide antenna for high directivity radiation according to an embodiment of the present invention to less than a half of the existing leaky-wave antenna.

Although exemplary embodiments of the present invention have been disclosed for illustrative purposes, it will be appreciated that the present invention is not limited thereto, and those skilled in the art will appreciate that various modifications, additions and substitutions are possible, without departing from the scope and purpose of the invention.

Accordingly, any and all modifications, variations or equivalent arrangements should be considered to be within the scope of the invention, and the detailed scope of the invention will be disclosed by the accompanying claims.

What is claimed is:

1. An apparatus to create uniform electric and magnetic-field distribution as zeroth-order resonance in a waveguide and a cavity, comprising:

a rectangular waveguide with a rectangular-shaped cross section comprising an internal cavity; and a conductive helical wire inserted into the cavity of the waveguide, wherein a main body of the conductive helical wire is arranged to be adjacent to, but does not contact, the inner surfaces of the waveguide at a predetermined gap, and both ends of the conductive helical wire are short-circuited to the inner surfaces of the waveguide, wherein the number of the turns and spacing between the turns of the conductive helical wire are predetermined.

2. The apparatus of claim 1, wherein a target zeroth-order resonance frequency of the waveguide is set to be equal to or less than the cut-off frequency of the waveguide in order to obtain a size-reduction for longer-waves in the limited space of the waveguide.

3. The apparatus of claim 2, wherein the conductive helical wire is arranged in the longitudinal direction of the waveguide and arranged to coil along the inner surfaces of the waveguide.

4. The apparatus of claim 1, wherein the conductive helical wire comprises a metal helical wire.

5. The apparatus of claim 1, wherein an uncoiled length of said conductive helical wire is two wavelengths of a target zeroth-order resonance frequency and the conductive helical wire has a repeated structure comprising two coils at a half-wavelength distance of the target zeroth-order resonance frequency in the longitudinal direction of the waveguide.

6. A leaky-wave waveguide antenna for high directivity radiation, comprising:

a rectangular waveguide with a rectangular-shaped cross section comprising an internal cavity; and a conductive helical wire inserted into the cavity of the waveguide, wherein a main body of the conductive helical wire is arranged to be adjacent to, but does not contact, the inner surfaces of the waveguide at a predetermined gap, and both ends of the conductive helical wire are short-circuited to the inner surfaces of the waveguide, wherein the waveguide comprises a single slit formed in the longitudinal direction penetrating the upper surface.

7. The antenna of claim 6, wherein a target zeroth-order resonance frequency of the waveguide is set to be equal to or less than the cut-off frequency of the waveguide in order to obtain a size-reduction for longer-waves in the limited space of the waveguide.

8. The antenna of claim 7, wherein the conductive helical wire is arranged in the longitudinal direction of the waveguide and arranged to coil along the inner surfaces of the waveguide.

9. The antenna of claim 6, wherein the conductive helical wire comprises a metal helical wire.

10. The antenna of claim 6, wherein an uncoiled length of said conductive helical wire is two wavelengths of a target zeroth-order resonance frequency and the conductive helical wire has a repeated structure comprising two coils at a half-wavelength distance of the target zeroth-order resonance frequency in the longitudinal direction of the waveguide, wherein the total coiled length of the helical wire in the longitudinal direction of the waveguide is much less than two wavelengths.

* * * * *